US006723938B1

(12) United States Patent
Gates

(10) Patent No.: US 6,723,938 B1
(45) Date of Patent: Apr. 20, 2004

(54) ELECTROSTATIC CONDUCTIVE INDUCTION SEPARATOR

(76) Inventor: Peter Jon Gates, 50 Charles Kurz Drive, Worongary (AU), 4213

( * ) Notice: Subject to any disclaimer, the term of this patent is extended or adjusted under 35 U.S.C. 154(b) by 0 days.

(21) Appl. No.: 09/936,476

(22) PCT Filed: Mar. 20, 2000

(86) PCT No.: PCT/AU00/00223

§ 371 (c)(1),
(2), (4) Date: Sep. 13, 2001

(87) PCT Pub. No.: WO00/56462

PCT Pub. Date: Sep. 28, 2000

(30) Foreign Application Priority Data

Mar. 22, 1999 (AU) ..... PP 9351
May 14, 1999 (AU) ..... PQ 0348

(51) Int. Cl.[7] ..... B03C 7/00

(52) U.S. Cl. ..... 209/128; 209/127.1; 209/129; 209/130; 209/127.4

(58) Field of Search ..... 209/127.1, 127.4, 209/128, 129, 130

(56) References Cited

U.S. PATENT DOCUMENTS 2,398,792 A * 4/1946 Johnson ..... 209/127.1
4,116,822 A * 9/1978 Webb ..... 209/127.1 X
4,251,353 A 2/1981 Knoll

FOREIGN PATENT DOCUMENTS

| | | | | |
|---|---|---|---|---|
| EP | 0006826 | | 1/1980 | |
| JP | 10-328579 A | | 12/1998 | |
| JP | 11-123346 | | 5/1999 | |
| RO | 109038 B1 | | 11/1994 | |
| SU | 854448 | | 8/1981 | |
| SU | 1331567 | * | 8/1987 | ..... 209/127.1 |
| SU | 1404117 | * | 6/1988 | ..... 209/127.1 |
| SU | 1479110 | * | 5/1989 | ..... 209/127.1 |

* cited by examiner

*Primary Examiner*—Donald P. Walsh
*Assistant Examiner*—Kaitlin Joerger
(74) *Attorney, Agent, or Firm*—Jennifer L. Skord; Moore & Van Allen, PLLC

(57) ABSTRACT

A particle separator for the separation of particulate mixture having species that exhibit difference in electrical conductivity. The separator has a conductive surface including a separation zone, has feeder means for feeding the species to the separation zone, and has an electrode arrangement for inducing charge in conducting species and lifting them from the conductive surface once charged. Also, the separator has cleaning means and drive means.

58 Claims, 6 Drawing Sheets

ELECTROSTATIC CONDUCTIVE INDUCTION SEPARATOR

TECHNICAL FIELD

The present invention is concerned with a particle separator for the separation of particulate mixtures comprising species that exhibit difference in electrical conductivity and, more particularly, with the separation of particulate mixtures comprising species that exhibit difference in electrical conductivity through electrostatic separation.

BACKGROUND ART

Mineral separation plants used in the titanium mineral processing industry world-wide consist essentially of similar process technologies applied in a manner that is often tailored to an individual ore bodies separation requirements. Dependent upon a wide number of factors including particle size and shape, mineral grade, geology of the ore body, type of mineral species present and the physical characteristics of said mineral species, a unique recovery process is applied to optimise plant performance and satisfy operational and capital cost targets. Nevertheless, all titanium mineral processing plants in the world utilise similar process technologies applied in varying ways to accomplish their process needs.

Mining is carried out by firstly excavating the ore and subjecting it to gravity concentration which isolates the heaviest particles into what is termed a heavy mineral concentrate. The heavy mineral concentrates are sent to a dry separation plant, where individual minerals species (of which there may up to 20 or more present) are separated using their different magnetic, electrical or other physical properties, often at elevated temperatures. Separation equipment commonly includes but is not limited to, high-tension electrostatic roll (HTR) and electrostatic plate (ESP) separators, as well as gravity and magnetic processes. Using electrostatic separation techniques the conductors such as rutile and ilmenite are separated from the non-conductors such as zircon, quartz and monazite. These separators are extensively used for the separation of conductor and non-conductor mineral species typically found in the titanium minerals industry.

A wide variety of electrostatic induced charge and ionised field separators have been invented over the last 90 years however the devices of existing commercial designs described below have undergone little fundamental change in recent years.

Based on the charging mechanisms employed, three basic types of "electrostatic" separators include; (1) high tension roll ionised field separators (HTR), (2) electrostatic plate and screen static field separators (ESP and ESS herein called ESP) and (3) triboelectric separators. ESP and HTR separators are the most commonly used today although in recent times some interest has been directed towards triboelectric separators however their application remains limited to mineral species that can be contact charged and so they are suitable for separations of non-conductor species only.

Customarily, HTR separators utilise a grounded roll that transports the feed material through the high voltage ionising field (corona) which charges the particles by ion bombardment. Conducting particles lose their charge to the earthed roll and are thrown from the roll by centrifugal and gravity forces. Non-conducting particles are pinned to the rotor and are transported further around the roll before their charge either dissipates and they are thrown off or are removed by either mechanical means (brush) or high voltage AC wiper.

ESP separators have an electrode designed to generate a static field and the particles are charged by conductive induction. In their common form ESP separators utilise a stationary grounded surface such as a plate over which the material flows, forming the connection to ground that particles must have to allow them to become charged by induction. Triboelectric separators do not use the electric field to effect particle charging. Particle to particle and/or particle to surface charging occurs when particle species with different contact charging potential are brought into contact with one another. The particle charge attained can then be utilised to effect a separation in a static electric field.

These three basic separation types are often not present alone in any mechanism and the machine characterisation essentially refers to the predominant or major separating effect. The present invention relies primarily on conductive induction to charge the particles and so the operation of an ESP separator is described in more detail below.

ESP conductive induction separators customarily comprise a curved, inclined electrically grounded plate onto and over which a feed mixture comprising species which differ in their electrical conductivity (some being conducting species or "conductors" and other being non-conducting species or "non-conductors") flows. The mixture is discharged onto this plate usually from a feed chute so that it travels over the plate due to gravity and in electrical contact with the plate surface.

The plate extends beside and below a high voltage electrode spanning the full width of the separation zone. The grounded plate is commonly curved, convex or "S" shaped, which provides good particle to plate contact when clean. Particles flowing over the grounded plate pass though the high potential electric field produced between the electrode and the plate itself whereupon a charge is induced into the conductive particles. These conductive particles acquire a charge of opposite polarity to the electrode whereas the non-conductive particles remain uncharged. The charged conductors are lifted off the grounded plate due to the physical attraction of oppositely charged bodies and are attracted towards the electrode.

Thus the conductors lift away from a gravitationally induced trajectory before falling through a splitter type collection means below and/or beyond the plates lower edge dividing the feed into a mainly conductor and a mainly non-conductor fraction.

The above description of the mechanism describes a one-stage separation process. Electrostatic Plate Separators (ESP) typically would incorporate 5 identical stages with up to two starts or individual streams being treated in one machine. Each new stage follows the last with material cascading from one stage to the next. Typically, conductors are gradually removed from the non-conductors whom continue on to the next stage for re-treatment.

Each stage is similar to the first with feed chute, grounded plate, electrode and splitter system duplicated and arranged one above the other in a vertical configuration. Adjustment of the splitters, electrode position and feed plate angle is typically done at each stage independently of other stages.

In the treatment of mixtures of particles with a range of physical characteristics including conductivity and particle size and density, it is necessary to adjust the relative positions of the feed plate, electrode and splitters to optimise the separation. It is usually necessary to adjust not only the air gap between plate and electrode but also the slope and shape of the plate and splitter positions independently on each stage. Voltage and polarity is traditionally similar over all starts and stages on each machine bank as a single high voltage power supply is used for simplicity reasons. A typical process in a plant may utilise many of these machines installed side by side or otherwise and if operating on the same duty, the operators would normally aim to set up electrode and splitter settings similarly for each machine.

There have also been proposals to use other than a grounded flat or curved plate, for example U.S. Pat. No. 2,258,767 discloses an electrostatic separating apparatus in which the grounded plate is formed into a roll. The roll rotates continuously and a portion thereof comes into appropriate juxtaposition with an electrode for conductive induction of charge in conducting species located on the surface of the roll. The invention is characterised in that the electrode is a rotatable cylindrical electrode and includes wiper means containing abrasive material co-operating with said electrode for polishing it as it rotates. At column 1 lines 16–26, it is said to be desirable to have a smooth surface on the high potential electrode in order to prevent the piling up of particles thereon, thereby forming discharge points and causing arcing to take place between the electrodes. The wiper employed in U.S. Pat. No. 2,258,767 achieves this by polishing the electrode surface and removing therefrom any particles which might tend to form discharge points. An angle is provided for guiding the material to be separated onto the roll, and this angle includes a swatch of material of the same kind as that used to polish the electrode to seal the gap between the angle and the roll. The purpose of the seal is to ensure that particulate material does not escape through the gap between the angle and the roll. The material that seals the gap seems not to act upon the separation roll and is apparently specified as being made from the same material as the wiper for the electrode on the basis that commonality of materials is good design practice in manufacturing such devices in order to reduce cost and facilitate provision of replacement parts. There is no discussion in U.S. Pat. No. 2,258,767 of any reduction in conductivity over time through surface contamination of the roll nor of any means for ameliorating this loss.

DISCLOSURE OF INVENTION

According to a first aspect of the present invention there is provided a particle separator for the separation of particulate mixtures comprising species that exhibit difference in electrical conductivity, comprising:

- a conductive surface including a separation zone over which said species move at a predetermined velocity, the electrical conductivity of which is reduced over time through surface contamination;
- feeder means for feeding said species to said separation zone;
- an electrode arrangement spaced apart from said conductive surface and capable of inducing charge in conducting species as they move across said separation zone and lifting said conducting species from said conductive surface once charged;
- cleaning means located other than within said separation zone for producing a conductive surface free from surface contamination; and
- drive means for movement of said conductive surface relative to said electrode arrangement in order to bring said conductive surface free from surface contamination into a position where it constitutes said separation zone.

Advantageously said cleaning means is spaced apart over said conductive surface from said feeder means.

Typically said feeder means feeds said species to an upper portion of said conductive surface and said species move downwardly through said separation zone. In this arrangement said cleaning means advantageously bears on a lower portion of said conductive surface below said separation zone but, in any event, is located outside of said separation zone. For example, where said conductive surface is generally cylindrical, said cleaning means may be located on the uppermost point of the generally cylindrical conductive surface with the feed of said species directed away from this region. However, it is preferred that said cleaning means bears upon the lowermost point of the generally cylindrical conductive surface.

In an arrangement in which two generally cylindrical conductive surfaces are appropriately juxtaposed, a single cleaning means may bear upon the lowermost point of one and the uppermost point of another.

Where said conductive surface is generally cylindrical, said drive means effects rotation of the generally cylindrical conductive surface in order to bring said conductive surface free from surface contamination into a position where it constitutes said separation zone.

Preferably the particle separator further comprises drive control means for indexing movement of said conductive surface through a plurality of zones, each zone in turn becoming said separation zone. For example, where said conductive surface is generally cylindrical indexed rotation of the generally cylindrical surface brings a different zone into the position where it can receive a feed of said species from said feeder means.

Advantageously said cleaning means includes cleaning control means for rotating same. Typically said cleaning control means causes said cleaning means to rotate concurrently with movement of said conductive surface, for example, to rotate concurrently with rotation of a generally cylindrical conductive surface. In a preferred form of the invention, said drive control means moves said conductive surface through at least several of said plurality of zones during an operational cycle before operation of said cleaning means is initiated. Thus, for example, feed may be applied to a plurality of zones located at different points around the circumference of a generally cylindrical conductive surface prior to initiating a cleaning cycle in which the conductive surface rotates through a single full rotation (i.e. through 360°) or through two or more full rotations in order to ensure that a surface free from surface contamination is produced.

Alternatively said drive control means moves said conductive surface from one zone to another with concurrent operation of said cleaning means. Thus there would be cleaning of a portion of said conductive surface during each indexed movement.

Advantageously said cleaning means is a cleaning or linish roll, drum, brush or cleaning pad.

Preferably said cleaning means is a roll brush or linish drum.

Surface contamination may arise in a number of forms but typically comprises ingrained particulate matter. The plates of electrostatic separators typically attract and become coated with non-conductive organic or inorganic film after hours or days of operation, and it has been found that removal of this type film improves performance of such separators.

Typically said feeder means meters said species onto said conductive surface at a predetermined rate.

Advantageously said feeder means comprises a feed plate whose angle of orientation is adjustable so as to be angled downwardly at between 25° and 50°. The feed plate length may also be adjustable.

In a particularly preferred form of the invention the particle separator further comprises a second separation zone. The second separation zone has an electrode arrangement spaced apart therefrom in the manner of the separation zone described above and operates in like manner. In order to allow for two separation zones, the feeder means is adapted for dual feed of said species to each of the separation zones.

Typically the feeder means comprises oppositely directed feed plates whose angle of orientation and length is adjustable in the manner described above.

Advantageously the particle separator further comprises collection means for separately collecting conducting species and non-conducting species. Mid-range conductors may be collected separately from strongly conducting species and the non-conducting stream may be fed to a further particle separation stage if impure.

Typically said electrode arrangement comprises a single or multiple element high voltage electrode.

Preferably said high voltage electrode or one or more elements thereof is a dielectric electrode. The elements of a multiple element high voltage electrode may be separate electrodes or can be separate portions of a single electrode separated by non-conducting buffers.

Advantageously said dielectric electrode comprises:

- a first glass substrate metallised on one of its surfaces to create an electrically conductive surface;
- a high voltage lead in electrical connection with said electrically conductive surface; and
- a dielectric material in electrically insulative abutment with said electrically conductive surface.

Typically said dielectric material is a second glass substrate.

In a particularly preferred embodiment of the invention a multiple element high voltage electrode is used, and said multiple element high voltage electrode comprises:

- a primary electrode for inducing charge in said species spaced apart from at least an upper section of said first separation zone; and
- a secondary electrode for lifting said species from said conductive surface once charged spaced apart from a lower section of said first separation zone.

It will be appreciated that a higher field density between said secondary electrode and said conductive surface than between said primary electrode and said conductive surface is advantageous since the larger the field the greater the tendency for charged particles to lift. However, even non-conducting particles will become charged if too high a field is employed between said primary electrode and said conductive surface, hence the field employed here must be of somewhat lesser intensity.

In a particularly preferred form of the invention said secondary electrode has a greater voltage applied thereto than said primary electrode, typically a 20% to 30% higher voltage.

Alternatively said secondary electrode may be positioned closer to said conductive surface than said primary electrode, and could include means for adjusting its position to vary the field between said secondary electrode and said conductive surface if desired. Said secondary electrode may also be orientated at a lesser angle to the vertical than said primary electrode in order to bring it close to a substantially vertical portion of said conductive surface when it is generally cylindrical in shape.

Alternatively a linear or curved single element high voltage electrode can be positioned above said first separation zone. If the electrode is curved, it is desirable that its curvature approximates that of the conductive surface.

According to a second aspect of the present invention there is provided a particle separator for the separation of particulate mixtures comprising species that exhibit difference in electrical conductivity, comprising:

- a conductive surface including a separation zone over which said species move at a predetermined velocity;
- feeder means for feeding species to said separation zone.
- an electrode arrangement spaced apart from said conductive surface and capable of inducing charge in conducting species as they move across said separation zone and lifting said conducting species from said conductive surface once charged, said electrode arrangement comprising a primary electrode for inducing charge in said conducting species spaced apart from at least a first portion of said separation zone within which said particulate material makes contact with said conductive surface, and a secondary electrode for lifting said conducting species from said conductive surface once charged spaced apart from a second portion of said separation zone within which said conducting species lift from said conductive surface.

Advantageously there is a higher field density between said secondary electrode and said conductive surface than between said primary electrode and said conductive surface, and this may be achieved in the manner described above.

Advantageously the particle separator further comprises a second separation zone.

Advantageously a primary electrode for inducing charge in said conducting species is spaced apart from at least a first portion of said second separation zone within which said species makes contact with said conductive surface, and a second electrode for lifting said conducting species once charged is spaced apart from a second portion of said second separation zone within which said conducting species lift from said conductive surface.

The feeder means in this apparatus is typically as described above.

Advantageously the particle separator further comprises cleaning means for producing a conductive surface free from surface contamination. Preferred forms of the cleaning means are as described above.

Typically said cleaning means is spaced apart over said conductive surface from said feeder means.

Advantageously a particle separator in accordance with this aspect of the invention further comprises drive means for movement of said conductive surface relative to said electrode arrangement. Movement of said conductive surface relative to said electrode arrangement may be continuous or intermittent in the manner described for other aspects of the invention.

Typically said conductive surface is generally cylindrical in shape.

According to a third aspect of the present invention there is provided a dielectric electrode comprising:

- a first glass substrate metallised on one of its surfaces to create an electrically conductive surface;
- a high voltage lead in electrical connection with said electrically conductive surface; and
- a dielectric material in electrically insulative abutment with said electrically conductive surface.

Typically said dielectric material is a second glass substrate.

According to a fourth aspect of the present invention there is provided a multi-stage particle separator for the separation of particulate mixtures comprising species that exhibit difference in electrical conductivity, comprising a particle separator as described above in operative association with a further particle separator or separators.

Advantageously, said further particle separator or separators is also as described above.

According to a fifth aspect of the present invention there is provided a process for the separation of particulate mixtures comprising species that exhibit difference in electrical conductivity, comprising the steps of:

1) providing a conductive surface including a separation zone over which said species move at a predetermined velocity, the conductivity of which reduces over time through surface contamination, which is spaced apart from an electrode arrangement capable of inducing charge in conducting species as they move across said conductive surface and lifting said species from said conductive surface once charged;
2) producing at least a portion of said conductive surface free from surface contamination; and
3) feeding said species onto said conductive surface free from surface contamination.

BRIEF DESCRIPTION OF DRAWINGS

Preferred embodiments of the present invention will now be described, by way of example only, with reference to the accompanying drawings, in which.

MODES FOR CARRYING OUT THE INVENTION

Figure 1:
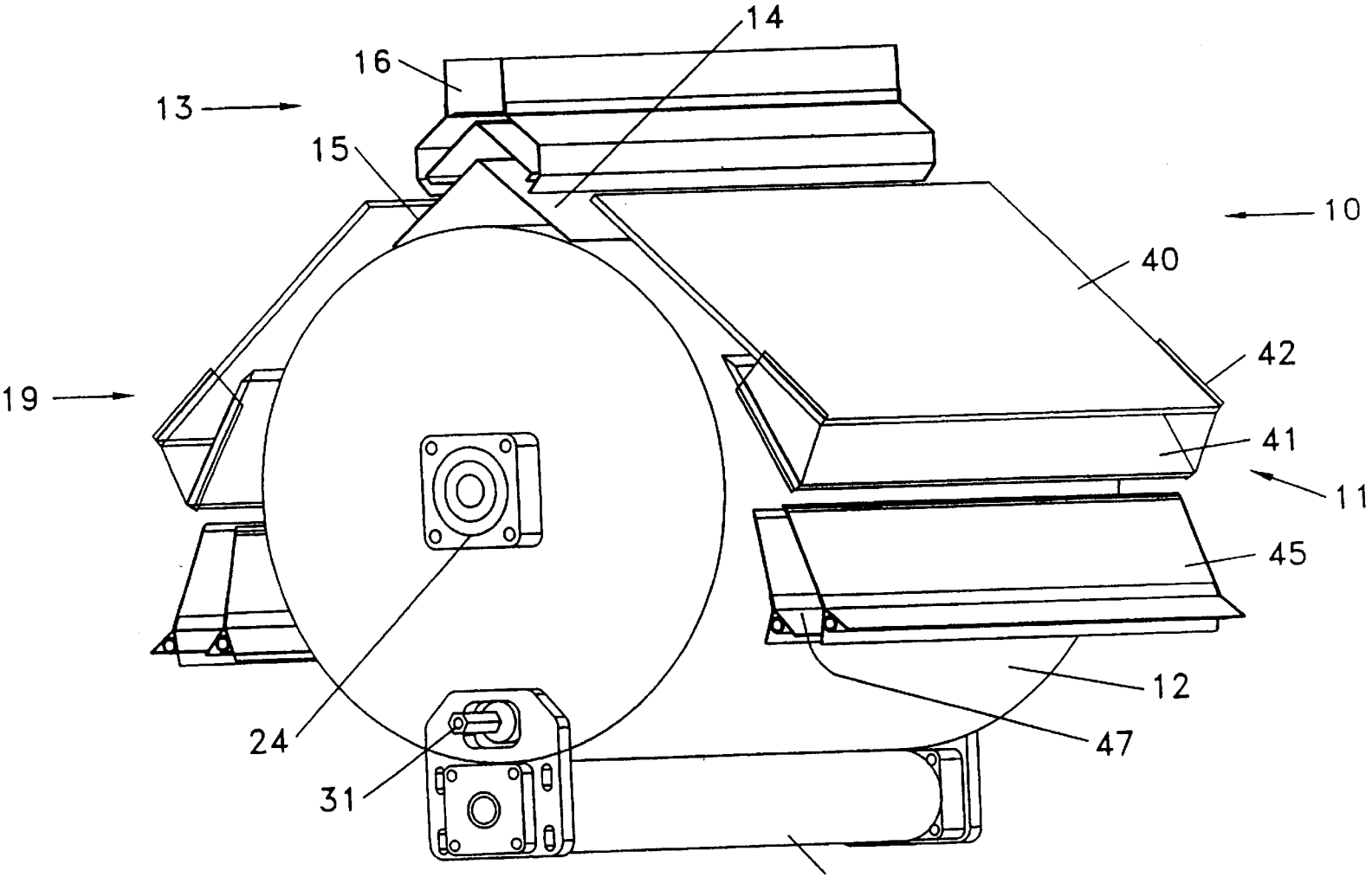
FIG. 1 is a perspective view of a particle separator in accordance with the present invention.
Figure 2:
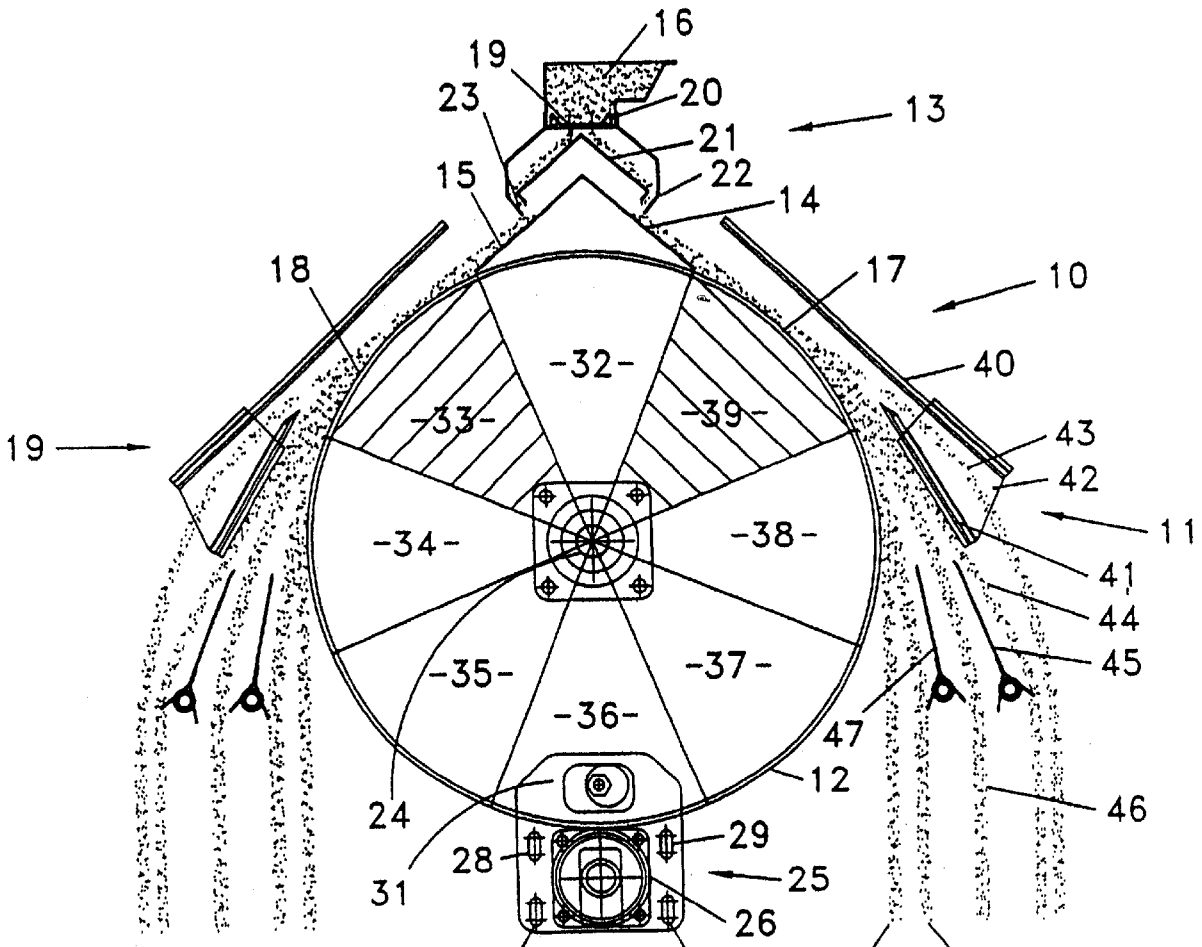
FIG. 2 is an end elevation of the particle separator shown in FIG. 1.
Figure 7:
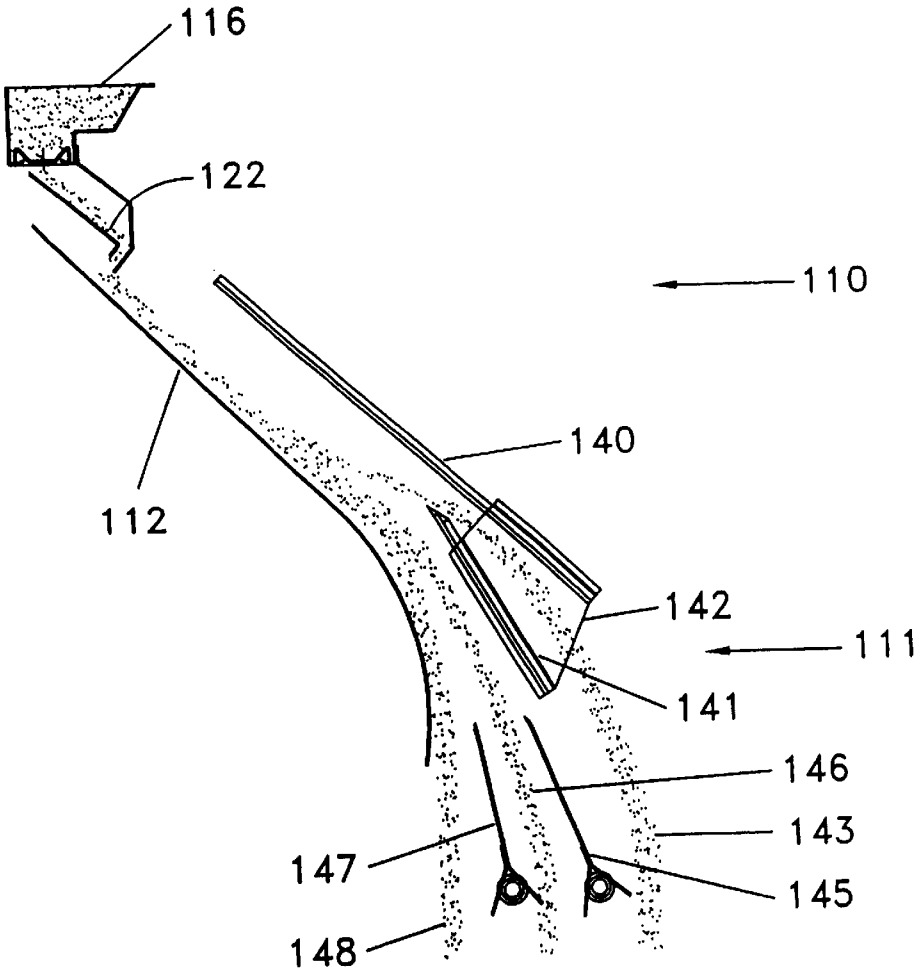
FIG. 7 shows the application of an electrode arrangement of the type shown in FIG. 4 to a plate separator.
Figure 8:
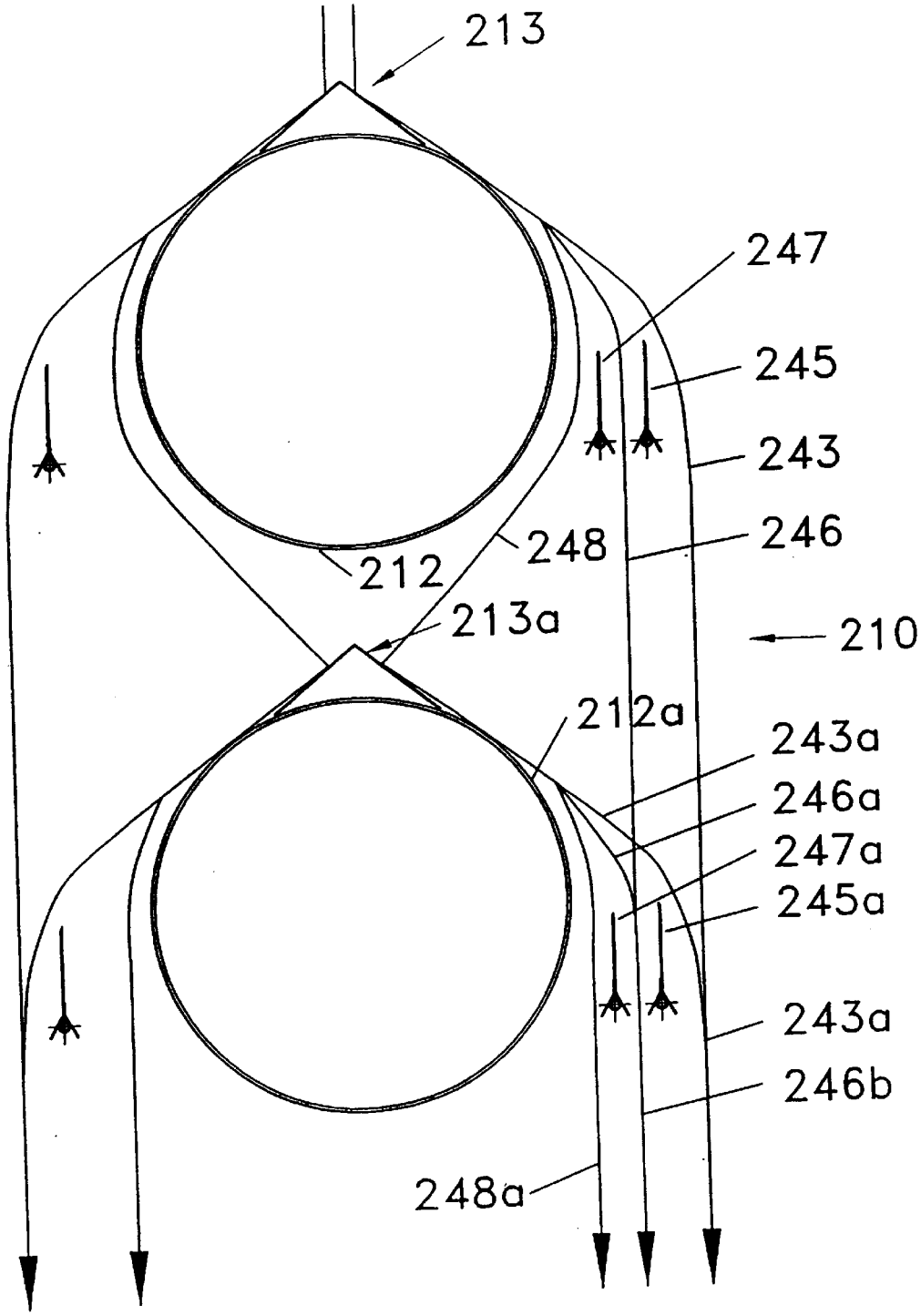
FIG. 8 is a schematic representation of a multi-stage particle separator in accordance with the present invention.

The particle separator 10 shown in FIGS. 1 and 2, the particle separator 110 in FIG. 7 and the multi-stage separator 210 shown in FIG. 8 are all used to separate particulate mixtures comprising species that exhibit difference in electrical conductivity, in particular, to separate electrically conducting species from non-conducting species on the basis of their capacities for conductive induction of charge.

While it is widely known that particles sliding over the surface of a chemically different material may become charged through the ability of one surface to release electrical charge to another chemically dissimilar surface, the magnitude of charge induced in this process is relatively small. While not wishing to be bound by theory, positioning an electrode above a conductive surface over which particulate mixtures comprising species that exhibit difference in electrical conductivity allows charging of conducting species through "conductive induction" and the magnitude of the charge generated in this way is much greater than that generated through contact charging. In essence, conductive induction occurs because the electrode arrangement 11 in FIGS. 1 and 2 and 4 to 6 and 111 in FIG. 7 tends to polarise particles sliding across the conductive surface 12, 112, 212 and 212*a* and conducting species may give up or receive electrons from the conductive surface. Non-conducting particles cannot do this and so do not become charged by this mechanism, although there may be slight charging by contact charging. For example, if an electrode with a negative polarity is used particles sliding over a conductive surface are polarised and give up electrons to the conducting surface if conductive, hence they become positively charged through conductive induction. However, most non-conductors will become slightly negatively charged through contact charging. Given that the positively charged particles are attracted to the negatively charged electrode, those charged through inductive coupling will be lifted from the conductive surface and those which remain uncharged or even have a slight negative charge will be repelled and remain on the surface until they fall therefrom under the influence of gravity. Thus separate streams of conducting and non-conducting particles are created. However, coating build-up problems ameliorate the charging ability of the conductive surface and lessens the efficiency of this operation.

Referring first to FIGS. 1 and 2, the particle separator 10 comprises an electrode arrangement 11 in electrical connection with a high voltage DC source and spaced apart from conductive surface 12, and feeder means 13. The feeder means 13 comprises a pair of oppositely disposed feed plates 14, 15 which serve to distribute two separate streams of said particulate mixture from a hopper 16 to a first separation zone 17 on conductive surface 12 and a second separation zone 18 on conductive surface 12. The hopper 16 includes a suitably sized orifice 19 in its bottom plate 20 for the particulate mixture to flow out of it at an appropriate rate under the influence of gravity. A single stream of material flows out of orifice 19 but strikes splitter 21 on its apex and is divided into two even streams which are delivered to the feed plates 14, 15 by narrow orifices 22, 23, which may be adapted to restrict and control the flow of said streams. The slope of the feed plates 14, 15 may vary, as may the position at which the feed plate delivers material onto the separation roll. Preferably, the feed plate mechanism slopes at an angle of 25° to 45° and the feed plates 14, 15 deliver said streams of particulate matter to approximately the 11 o'clock and 1 o'clock positions on the cylindrical conductive surface 12. The feed plates 14, 15 are length adjustable in order to alter the position at which said feed streams are delivered. The length of the feed plate and angle of the feed plate are selected for a specific particulate mixture in order to ensure that the material flows onto the conductive surface 12 at a rate which ensures that the momentum of the flow is continuous and controlled to suit the feed stream characteristics and particle sizes. It will be appreciated that the use of a twin-feed in this way ensures that the feed capacity of the machine is doubled with minimal additional machine cost or size.

The conductive surface 12, or as it is hereinafter referred to, the separation roll, is ordinarily stationary but includes drive means (not shown) for driving it in a rotational motion about central axle and bearing 24. Also provided is a drive control mechanism (not shown) for indexing movement of said conductive surface. The drive control means comprises a proximity switch (not shown) which detects the angular position of the separation roll 12 providing roll position information to a central control system which periodically indexes the separation roll to a new angular position. This allows feed particles to flow over a clean electrically conductive area of the roll surface in a manner to be described in more detail below. Feed may be continuous during this indexing movement or may be discontinued if desired. It will be appreciated that throughout the separation process, surface contamination progressively increases to a point where the efficiency of operation of a particular portion of the separation roll is likely to be compromised, and then indexed movement of the separation roll is initiated. This may happen either through a feedback mechanism detecting conductivity of the separation roll or may be a timed operation based on the likelihood of a decrease in conductivity occurring in a certain period of time.

Cleaning means 25 bears on the lowermost portion of the separation roll 12. The cleaning means 25 comprises a linish roll 26 which bears upon the surface of separation roll at said lowermost point and is rotatable in order to initiate cleaning. The cleaning means 25 also includes adjustment mechanism 31 and slotted orifices 27, 28, 29, 30 adapted to receive screws for securement of the cleaning means 25 to a mounting bracket (not shown). The linish roll includes cleaning control means (not shown) which induce rotation in the linish roll. Advantageously rotation in the linish roll is induced when the separation roll 12 is rotating in a cleaning cycle, to be described in more detail below, or otherwise, during indexed movement of the separation roll. The former may be envisaged by dividing a separation roll 12 arbitrarily into a number of zones which would in turn receive feed from the feeder means 13. Consider zone 32, which includes the uppermost point of the separation roll 12. There is no feed directed to this zone and so cleaning means such as cleaning means 25 could equally well be located here. Nevertheless, feed is directed to separation zone 18 to one side of zone 32 and so slides across zones 33 and 39, respectively, and separation 17 to the other side. If there is indexed movement (once the zones 33 and 39 have suffered surface contamination) in the clockwise direction, zone 32 moves into separation zone 17 to replace zone 39. Likewise, zone 34 moves into separation zone 18 to replace zone 33. Feed to these zones continues for a period of time but then a further, but greater, indexed movement will in turn bring zone 35 into the separation zone 17 and zone 37 into the separation zone 18. A further indexed movement brings zones 36, 38 into separation zones 17, 18, respectively, to receive feed from the feed plates 14, 15. Surface contamination will have built up in each of the zones as they receive feed and their conductivity will have been correspondingly reduced. Accordingly, once the drive control means senses that this cycle has been completed, a cleaning cycle is initiated where the surface roll 12 rotates through its full circumference with concurrent rotation of linish roll 26 in order to remove surface contamination including ingrained particulate matter. If a single rotation of the separation roll 12 is sufficient for the surface thereof to be freed of contamination, then only a single rotation will be completed. However, multiple rotations with concurrent cleaning of the separation roll 12 are envisaged. Once the cleaning cycle is concluded, the separation roll returns to the position shown and the cycle recommences.

In the alternative, the linish roll 26 may rotate and clean the portion of the separation roll 12 with which it is in contact at the time during each indexed movement of the separation roll 12. However, the former arrangement involving a separate cleaning cycle is preferred since it does allow for cleaning of the separation roll 12 through more than one rotation thereof to ensure that all surface contamination is removed.

Typically the feed material may be processed for a duration of hours of days prior to the roll being indexed to a clean part of the separation roll surface. The roll can be indexed four times as described above to provide clean surfaces to both separation zones on the roll concurrently, at which time the cleaning function commences. The cleaning function may simply require one revolution of the separation roll prior to the restarting of the indexing cycles as described with the whole cycle repeated indefinitely.

It has been found that rotating a 700 mm diameter separation roll at a speed of around 2–4 rpm has minimal effect on the trajectory of non-conducting species or metallurgical separation performance. This allows for the fact that material is fed over both sides of the separation roll concurrently. A faster roll speed could be tolerated provided that the effect on the trajectory of the non-conducting species is not sufficient to cause mixing of the streams or otherwise make their collection difficult and that the feed particle flow over the separation surface is not upset. It is envisaged that the feed material does not need to be interrupted prior to commencing either an indexing or cleaning cycle and that the separation process can continue throughout these operational functions without significant loss in metallurgical performance. Moreover, it will be appreciated that indexed rotation using a semi-circular conductive surface and indexed movement of inductive surfaces of other shapes can be employed in similar manner.

Figure 5:
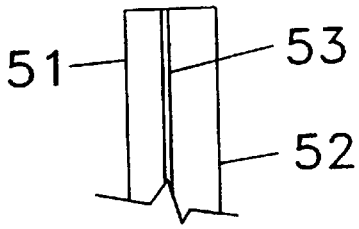
FIG. 5 is a cross-section along line 5—5 in FIG. 4.
Figure 6:
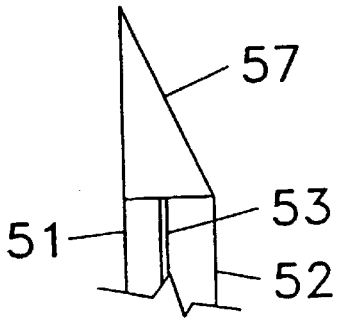
FIG. 6 is a cross-section along line 6—6 in FIG. 4.
Figure 4:
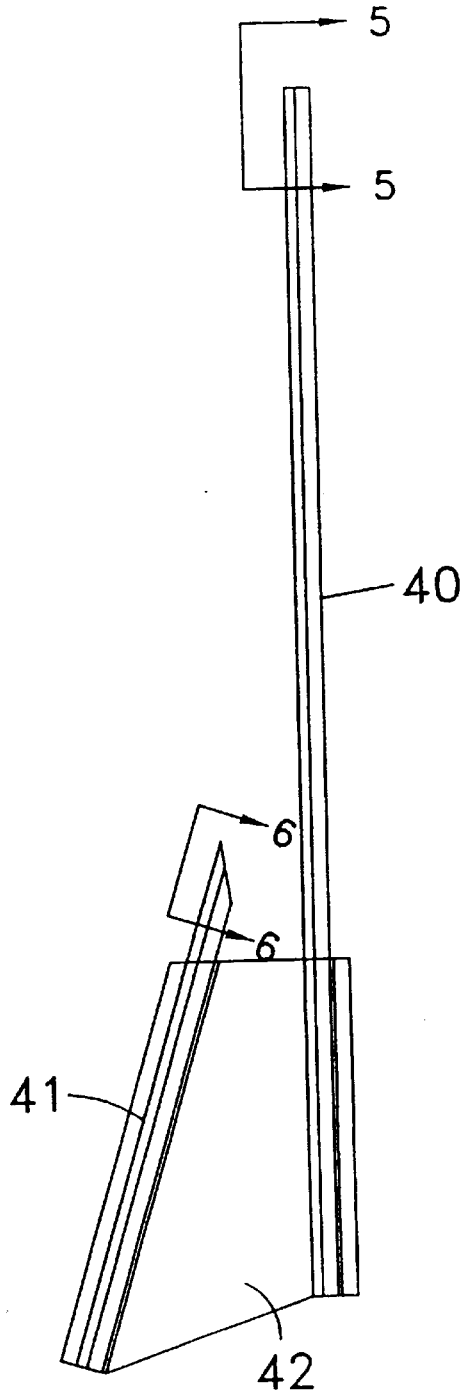
FIG. 4 shows detail of the primary electrode and secondary electrode illustrated in FIGS. 1 and 2.

The electrode arrangement 11 comprises of primary electrode 40 and a secondary electrode 41, and this arrangement is seen in more detail in FIGS. 4 to 6 and similar electrodes 140, 141 are illustrated in FIG. 7. Primary electrode 40 is mounted in the conventional manner and secondary electrode 41 is connected thereto by dielectric connector 42 to keep them electrically separated.

This arrangement is preferred, although it will be appreciated that the single high voltage electrode, whether flat or curved, may be used. An electrode curved to remain substantially parallel to the surface of a separation roll 12 is particularly preferred for separation rolls of relatively small diameter since a more uniform electric field is created in this way. However, roll diameter may vary within a wide range, and a roll is typically between 300 mm and 1200 mm in diameter. Larger rolls are less influenced by non-uniformity of the electric field and so non-uniformity does not appear to seriously affect the separator performance.

Where an electrode arrangement 11 as illustrated in FIGS. 1 and 2 is used, the primary electrode is typically flat and extends lengthways (co-axially with the separation roll) slightly more than the full feed width to ensure continuity of the electric field at its extremity. The primary electrode in embodiments shown is angled at approximately 50° to the vertical and extends down and away from the separation roll surface 12 at its lower end. The effective increasing distance from the electrode to the separation roll surface changes the electric field strength by an inversely proportional amount. Accordingly, at approximately a similar elevation to where conducting species leave the roll surface under their normal trajectory, a secondary electrode is installed. The secondary electrode enhances the electric field strength in the lower section of the separation zone to enhance attraction of the charged particles to the electrode and thereby enhance lifting. This allows for a more definite separation of weakly charged or more massive particles.

The secondary electrode 41 is also angled away and downwards at a lesser angle to the primary electrode 40, thereby reducing the air gap between itself and the separation roll surface. This increases the force (at similar electrode voltage) applied on the charged particles, resulting in maximum displacement from their normal trajectory and enhance separation performance. In addition to this reduced air gap, the secondary electrode voltage can be increased beyond that of the primary electrode to further enhance particle lifting. Typically, lower voltage is applied to the primary electrode 40 since particle charging is a more delicate exercise than particle lifting, and it is quite possible to overcharge, saturate and lift even good non-conductors if excessive voltage is applied whilst the particle is in contact with the separation roll 12. No such problem is encountered once the particle is no longer in contact with the separation roll 12, allowing increased voltage to be applied for lifting. Typically, a 20% to 30% higher voltage can be applied to the secondary electrode in order to maximise separation performance.

Thus, as best seen in FIG. 2, a stream 43 of lifted conductive species and a second stream 44 of lifted conductive species that are more massive and/or less highly charged are produced and partitioned from the other streams by conductor splitter 45. The particle stream 42 passes between the primary electrode 40 and the secondary electrode 41, but the more massive or less highly charged particles in the particle stream 44 pass beneath the secondary electrode 41 and thus are the particles which are substantially affected by its presence. A mid conducting stream 46 passes between conductor splitter 45 and non-conductor splitter 47 and is collected while stream of non-conductors 48, 49 may also be noted in FIG. 2. The non-conductors may be collected or the streams 48, 49 may pass to a further separation stage. If a mineral separation process is undertaken with this apparatus, typically conductors such as rutile and ilmenite are separated into conductor streams 43, 44 and a mid-conductor stream 46, respectively and non-conductors such as zircons, quartz and monazite remain in the non-conductor streams 48, 49.

Figure 3:
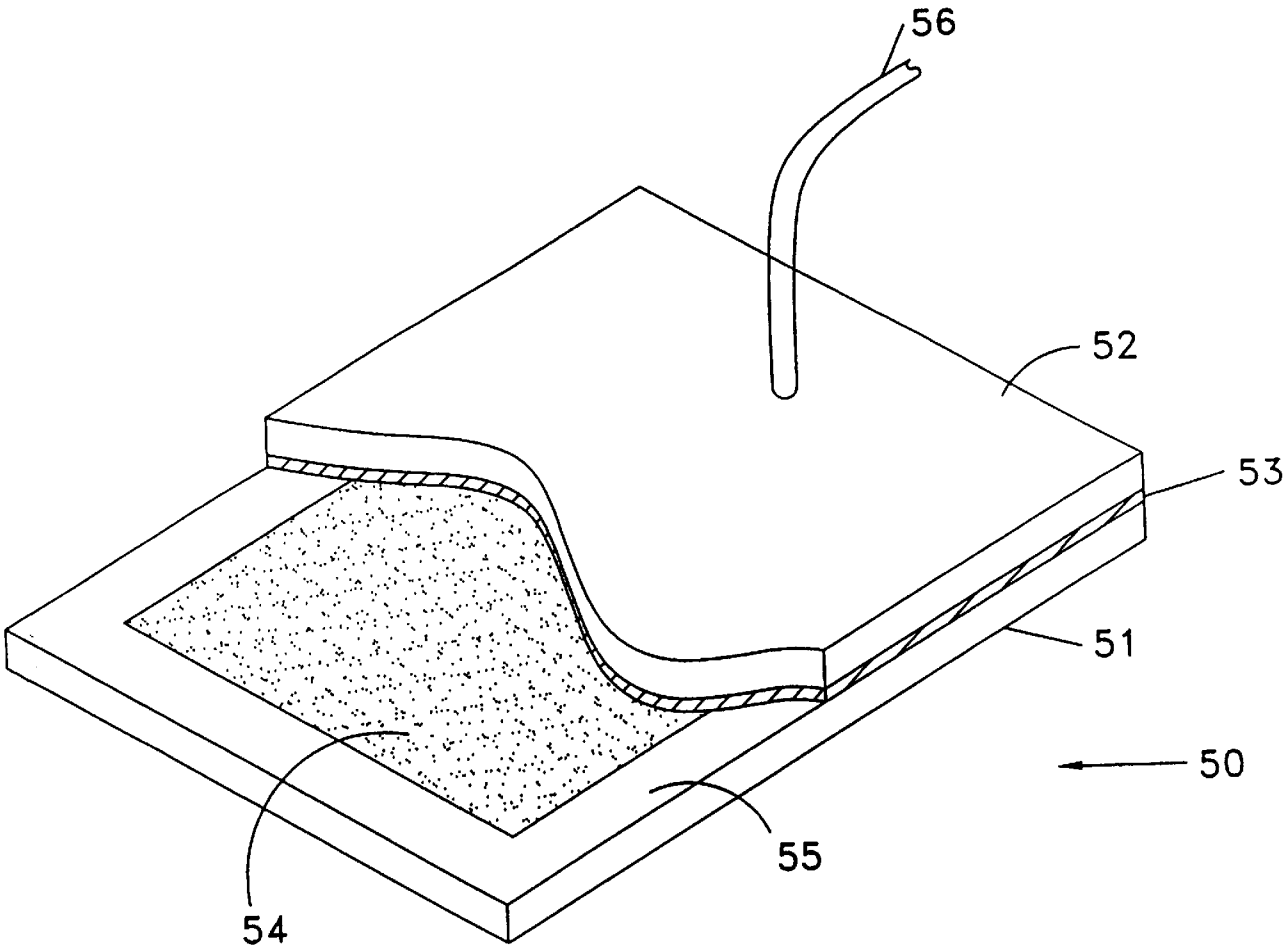
FIG. 3 is a perspective view of a dielectric electrode in accordance with the present invention.

In a particularly preferred embodiment of the invention dielectric electrodes as shown in FIG. 3 and illustrated in use in FIGS. 4 to 6 are used. Nevertheless, the dielectric electrode 50 illustrated in FIG. 3 may be used in other applications as well as the use illustrated in FIGS. 4 to 6. The electrode 50 comprises a first glass sheet 51 metallised over a portion of its top surface 55, the metallised surface being shown by dotted surface 54. A second glass layer 52 is placed over the first glass layer 51 with a polymer laminating layer 53 being positioned therebetween during assembly after a high voltage lead 56 is placed in electrical connection with the metallised surface 54. Thus, a dielectric electrode in which the conducting portion, the metallised surface 54, is not exposed is created. However, it will be appreciated that other means for bringing the two glass sheets 51, 52 into electrically insulative abutment such as clamps and the like can be used. It will also be appreciated that electrodes of this type may be made using other dielectric materials and, for example, one sheet may be of glass and the other of epoxy. Indeed, the backing does not need to be non-conductive, although for operator safety it is desirable to fully insulate the electrodes.

The conducting layer can be a thin silver, copper or other metallised surface. Electrodes of this type may be conveniently shaped into a number of shapes including flat plates, curved or other shaped electrodes and are conveniently used to create ultra-static electric fields in conductive induction electrostatic separators. To improve temperature tolerance and reduce the danger if breakage occurs, toughened glass is preferred. Alternatively, borosilicate or other high temperature resistant glass can be used as a dielectric material. Glass is particularly preferred as it is semi-conductive and allows a very small current flow through it at high voltages. This appears to help in reducing sticking of conductor particles to the electrode surface.

It is particularly preferred that the glass sheets 51, 52 be laminated and toughened electrically conductive "low emission" glass or silver "mirror" glass.

The electrodes are conveniently prepared by attaching the high voltage lead 56 to the metallised surface 54 and then laminating the glass sheet 51 to a second glass sheet 52. In particular, where "low emission" glass is laminated to a sheet of toughened float glass, the "low emission" glass sheet 51 is prepared by sandblasting or mechanically removing the conductive layer from the outermost edges of its top surface 55. This ensures that upon charging the finished assembly, current leakage does not occur at the electrode edges. Secondly, an epoxy bus bar is stenciled or printed to its conductive surface, to which is soldered the high voltage input lead. The two glass panels 51, 52 are then laminated together in a conventional manner with one end of the high voltage lead being permanently fixed to the conductive surface and the other end extending from the electrode. An insulating material such as cap 57 can then be cast or fixed to the leading or other edges of the electrode. This can be useful to prevent ionisation from the leading edge as well as to prevent deflected material from striking a blunt face and bouncing as the case may be with secondary electrodes as shown, for example, in FIG. 2. Preferably corners of the electrode are moulded to reduce ionisation.

The use of a primary and secondary electrode arrangement in connection with a flat plate separator is shown in FIG. 7. In this arrangement a hopper 116 feeds particulate material through narrow orifice 112 onto the conductive surface 112. Primary electrode 140 is orientated above the conductive surface generally in a manner described above for the separation roll 12. Likewise, secondary electrode 141 is located above the conductive surface 112, and it functions broadly in the manner described above also. A stream of conductors 143, mid-conductors 146 and non-conductors 148 is produced, although minor streams of conductors equivalent to stream 44 and of non-conductors equivalent to stream 49 may also be produced. Conductor splitter 145 and non-conductor splitter 147 function in a manner analogous to splitters 45 and 47. This embodiment of the invention illustrates that the dual electrode concept is applicable to separators other than roll separators such as roll separator 12, and to conductive surfaces generally of any shape. Accordingly, an arrangement of this type may be retrofitted to existing separator apparatus.

FIG. 8 illustrates schematically a multi-stage separator employing a particle separator as described above. A separation roll 212 in the first stage and the separation roll 212*a* in the second stage of particle separator 210 are orientated with their axes parallel and in vertical alignment. Thus the conductor stream 243 produced in the manner described above is directed by conductor splitter 245 in the path illustrated and ultimately united with a conductor stream 243*a* from second separation roll 212*a* to produce a final conductor stream 212*b*, which is collected. Likewise the mid-conductor stream 246 is united with a mid-conductor stream 246*a* produced by separation roll 212*a* to produce a stream 246*b* which is collected. The fate of the non-conductor stream 248*a* from first separation roll 212 is again as described above. Rather than being collected, it is directed to feeder means 213*a* where it is fed to separation roll 212*a* and split into the streams 243*a*, 246*a* and 248*a*, 248*a* being a further non-conductor stream and 243*a* and 246*a* being additional conductor and mid-conductor streams, respectively. The non-conductor stream 248*a* is collected or discarded. Alternatively, if a third stage is included the process described above in relation to the second stage including separation roll 212*a* is repeated once again. The apparatus illustrated in FIG. 8 has a separation zone and feed stream to either side of each separation roll, and analogous processes are carried out on either side of the separation roll.

INDUSTRIAL APPLICABILITY

The present invention is useful in separation of particle mixtures comprising species that exhibit a difference in electrical conductivity. In particular, the invention is useful in mineral separation processes, most particularly to titanium mineral process plants. However, many applications exist in areas such as scrap recovery, iron ore or industrial mineral beneficiation processes, whereby this invention can be used to greatly enhance product recovery and grades of materials.

What is claimed is:

1. A particle separator for the separation of particulate mixtures comprising species that exhibit difference in electrical conductivity, comprising:

a conductive surface including a separation zone over which said species move at a predetermined velocity, the electrical conductivity of which is reduced over time through surface contamination;

feeder means for feeding said species to said separation zone;

an electrode arrangement spaced apart from said conducive surface for inducing charge in conducting species as they move across said separation zone and lifting said conducting species from said conductive surface once charged;

cleaning means located other than within said separation zone for producing a conductive surface free from surface contamination; and drive means for movement of said conductive surface relative to said electrode arrangement in order to bring said conductive surface free from surface contamination into a position where it constitutes said separation zone.

2. A particle separator as claimed in claim 1 wherein said cleaning means is spaced apart over said conductive surface from said feeder means.

3. A particle separator as claimed in claim 1 wherein said feeder means feeds said species to an upper portion of said conductive surface and said species move downwardly through said separation zone.

4. A particle separator as claimed in claim 2 wherein said cleaning means bears on a lower portion of said conductive surface below said separation zone.

5. A particle separator as claimed in claim 1 wherein said conductive surface is generally cylindrical and said drive means effects rotation of the generally cylindrical conductive surface.

6. A particle separator as claimed in claim 5 wherein said cleaning means bears upon the lowermost point of the generally cylindrical conductive surface.

7. A particle separator as claimed in claim 6 wherein said cleaning means bears additionally on the uppermost point of a further, appropriately positioned, generally cylindrical conductive surface.

8. A particle separator as claimed in claim 1 further comprising drive control means for indexing movement of said conductive surface through a plurality of zones, each in turn becoming said separation zone.

9. A particle separator as claimed in claim 8 wherein said cleaning means includes cleaning control means for rotating same.

10. A particle separator as claimed in claim 9 wherein said cleaning control means causes said cleaning means to rotate concurrently with movement of said conductive surface.

11. A particle separator as claimed in claim 10 wherein said drive control means moves said conductive surface through at leas several of said plurality of zones during an operational cycle before operation of said cleaning means is initiated.

12. A particle separator as claimed in claim 10 wherein said drive control means moves said conductive surface from one zone to another with concurrent operation of said cleaning means.

13. A particle separator as claimed in claim 1 wherein said cleaning means is a cleaning or linish roll, drum, brush or cleaning pad.

14. A particle separator as claimed in claim 11 wherein said cleaning means is a roll brush or linish drum.

15. A particle separator as claimed in claim 1 wherein ingrained particulate matter is removed from said conductive surface.

16. A particle separator as claimed in claim 1 wherein said feeder means meters said species onto said conductive surface at a predetermined rate.

17. A particle separator as claimed in claim 16 wherein said feeder means comprises a feed plate whose angle of orientation is adjustable so as to be angled downwardly at between 25° and 50°.

18. A particle separator as claimed in claim 17 wherein said feed plate is length adjustable.

19. A particle separator as claimed in claim 1, further comprising a second separation zone.

20. A particle separator as claimed in claim 19 wherein said feeder means is adapted for dual feed of said species to each of the separation zones.

21. A particle separator as claimed in claim 1 wherein said feeder means comprises oppositely directed feed plates.

22. A particle separator as claimed in claim 21 wherein the angle of orientation of each of the feed plates is adjustable so as to be angled downwardly at between 25° and 50°.

23. A particle separator as claimed in claim 22 wherein each feed plate is length adjustable.

24. A particle separator as claimed in claim 1, further comprising collection means for, separately collecting said conducting species and non-conducting species.

25. A particle separator as claimed in claim 1 wherein said electrode arrangement comprises a single or multiple element high voltage electrode.

26. A particle separator as claimed in claim 25 wherein said high voltage electrode or one or more elements thereof is a dielectric electrode.

27. A particle separator as claimed in claim 26 wherein said dielectric electrode comprises:

a first glass substrate metallised on one of its surfaces to create an electrically conductive surface;

a high voltage lead in electrical connection with said electrically conductive surface; and a dielectric material in electrically insulative abutment with said electrically conductive surface.

28. A particle separator as claimed in claim 27 wherein said dielectric material is a second glass substrate.

29. A particle separator as claimed in claim 25 wherein a multiple element high voltage electrode is used, and said multiple element high voltage electrode comprises:

a primary electrode for inducing charge in said species spaced apart from at least an upper section of said first separation zone; and a secondary electrode for lifting said species from said conductive surface once charged spaced apart from a lower section of said first separation zone.

30. A particle separator as claimed in claim 29 wherein there is a higher field density between said secondary electrode and said conductive surface than between said primary electrode and said conductive surface.

31. A particle separator as claimed in claim 30 wherein said secondary electrode is positioned closer to said conductive surface than said primary electrode.

32. A particle separator as claimed in claim 30 wherein said secondary electrode is oriented at a lesser angle to the vertical than said primary electrode.

33. A particle separator as claimed in claim 30 wherein said secondary electrode has a greater voltage applied thereto than said primary electrode.

34. A particle separator as claimed in claim 33 wherein a 20 to 30% higher voltage is applied to said second electrode.

35. A particle separator as claimed in claim 25 wherein a linear, single element high voltage electrode is positioned above said separation zone.

36. A particle separator as claimed in claim 25 wherein a curved, single element high voltage electrode is positioned above said separation zone.

37. A particle separator as claimed in claim 35 wherein the curvature of the electrode approximates that of the conductive surface.

38. A particle separator for the separation of particulate mixtures comprising species that exhibit difference in electrical conductivity, comprising:

a conductive surface including a separation zone over which said species move at a predetermined velocity;

feeder means for feeding said species to said separation zone;

an electrode arrangement spaced apart from said conducive surface for inducing charge in conducting species as they move across said separation zone and lifting said conducting species from said conductive surface once charged, said electrode arrangement comprising a primary electrode for inducing charge in said conducting species spaced apart from at least a first portion of said separation zone within which said particulate material makes contact with said conductive surface, and a secondary electrode for lifting said conducting species from said conductive surface once charged spaced apart from a second portion of said separation zone within which said conducting species lift from said conductive surface.

39. A particle separator as claimed in claim 38 wherein there is a higher field density between said secondary electrode and said conductive surface than between said primary electrode and said conductive surface.

40. A particle separator as claimed in claim 39 wherein said secondary electrode is positioned closer to said conductive surface than said primary electrode.

41. A particle separator as claimed in claim 39 wherein said conductive surface is curved and said secondary electrode is oriented at a lesser angle to the vertical than said primary electrode.

42. A particle separator as claimed in claim 39 wherein said secondary electrode has a greater voltage applied thereto than said primary electrode.

43. A particle separator as claimed in claim 42 wherein a 20 to 30% higher voltage is applied to said second electrode.

44. A particle separator as claimed in claim 38, further comprising a second separation zone.

45. A particle separator as claimed in claim 44 wherein a primary electrode for inducing charge in said conducting species is spaced apart from at least a first portion of said second separation zone within which said species makes contact with said conductive surface, and a second electrode for lifting said conducting species once charged is spaced apart from a second portion of said second separation within which said conducing species lift from said conductive surface.

46. A particle separator as claimed in claim 44 wherein said feeder means is adapted for dual feed of said species to each of the separation zones.

47. A particle separator as claimed in claim 46 wherein said feeder means comprises oppositely directed feed plates.

48. A particle separator as claimed in claim 47 wherein the angle of orientation of each of the feed plates is adjustable so as to be angled downwardly at between 25° and 50°.

49. A particle separator as claimed in claim 48 wherein each feed plate is length adjustable.

50. A particle separator as claimed in claim 38, further comprising cleaning means for producing a conductive surface free from surface contamination.

51. A particle separator as claimed in claim 50 wherein said cleaning means is spaced apart over said conductive surface from said feeder means.

52. A particle separator as claimed in claim 51, further comprising drive means for movement of said conductive surface relative to said electrode arrangement.

53. A particle separator as claimed in claim 38 wherein said conductive surface is generally cylindrical.

54. A dielectric electrode comprising:

a first glass substrate metallised on one of its surfaces to create an electrically conductive surface;

a high voltage lead in electrical connection with said electrically conductive surface; and a dielectric material in electrically insulative abutment with said electrically conductive surface.

55. A dielectric electrode as claimed in claim 54 wherein said dielectric material is a second glass substrate.

56. A multi-stage particle separator for the separation of particulate mixtures comprising species that exhibit difference in electrical conductivity, comprising a particle separator in accordance with claim 1 in operative association with a further particle separator or separators.

57. A multi-stage particle separator according to claim 56 in combination with a particle separator for the separation of particulate mixtures comprising species that exhibit difference in electrical conductivity, comprising:

a conductive surface including a separation zone over which said species move at a predetermined velocity, the electrical conductivity of which is reduced over time through surface contamination;

feeder means for feeding said species to said separation zone;

an electrode arrangement spaced apart from said conductive surface for inducing charge in conducting species as they move across said separation zone and lifting said conducting species from said conductive surface once charged;

cleaning means located other than within said separation zone for producing a conductive surface free from surface contamination; and drive means for movement of said conductive surface relative to said electrode arrangement in order to bring said conductive surface free from surface contamination into a position where it constitutes said separation zone.

58. A process for the separation of particulate mixtures comprising species that exhibit difference in electrical conductivity, comprising the steps of:

providing a conductive surface including a separation zone over which said species move at a predetermined velocity, the conductivity of which reduces over time through surface contamination, which is spaced apart from an electrode arrangement for inducing charge in conducting species as they move across said conductive surface and lifting said species from said conductive surface once charged;

producing at least a portion of said conductive surface free from surface contamination; and feeding said species onto said conductive surface free from surface contamination.

* * * * *